US007611284B2

(12) United States Patent
Borchardt et al.

(10) Patent No.: US 7,611,284 B2
(45) Date of Patent: Nov. 3, 2009

(54) CLOSURE DEVICE

(75) Inventors: Michael G. Borchardt, Willowbrook, IL (US); Ronald J. Cisek, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 922 days.

(21) Appl. No.: 10/832,154

(22) Filed: Apr. 26, 2004

(65) Prior Publication Data

US 2005/0235468 A1 Oct. 27, 2005

(51) Int. Cl.
*B65D 33/16* (2006.01)
*A44B 19/00* (2006.01)

(52) U.S. Cl. ..... 383/63; 24/585.12

(58) Field of Classification Search ..... 383/63–64; 24/399–400, 585.12
See application file for complete search history.

(56) References Cited

U.S. PATENT DOCUMENTS

| | | | |
|---|---|---|---|
| 3,806,998 | A | 4/1974 | Laguerre |
| 4,186,786 | A | 2/1980 | Kirkpatrick |
| 4,285,105 | A | 8/1981 | Kirkpatrick |
| 4,736,496 | A | 4/1988 | Fisher et al. |
| 4,829,641 | A | 5/1989 | Williams |
| 5,007,143 | A | 4/1991 | Herrington |
| 5,059,036 | A | 10/1991 | Richison et al. |
| 5,070,584 | A | 12/1991 | Dais et al. |
| 5,138,750 | A | 8/1992 | Gundlach et al. |
| 5,140,727 | A | 8/1992 | Dais et al. |
| 5,140,796 | A | 8/1992 | Pope |
| 5,248,201 | A | 9/1993 | Kettner et al. |
| 5,307,552 | A | 5/1994 | Dais et al. |
| 5,356,222 | A | 10/1994 | Kettner et al. |
| 5,363,540 | A | 11/1994 | Dais et al. |
| 5,397,182 | A | 3/1995 | Gaible et al. |
| 5,403,094 | A | 4/1995 | Tomic |
| 5,405,478 | A | 4/1995 | Richardson et al. |

(Continued)

FOREIGN PATENT DOCUMENTS

| | | |
|---|---|---|
| EP | 0510797 | 10/1992 |

(Continued)

*Primary Examiner*—Jes F. Pascua
(74) *Attorney, Agent, or Firm*—Thomas C. Feix; Ann Lee

(57) ABSTRACT

A closure device having first and second fastening strips arranged to be interlocked over a predetermined length is provided. Each of said first and second fastening strips includes first and second closure elements separated by an intermediate area, wherein the first closure element on the first fastening strip is arranged to be interlocked over a predetermined length with the first closure element on the second fastening strip, and the second closure element on the first fastening strip is arranged to be interlocked over a predetermined length with the second closure element on the second fastening strip. Each of the closure elements may be colored with a colorant. For example, the closure elements on one fastening strip may be colored with an opaque pigment, and the intermediate area on that fastening strip may colored with a first translucent pigment. The closure elements on the other fastening strip may be colored with a translucent pigment, and the intermediate area on that fastening strip may be colored with a second opaque pigment. When the closure device is occluded, the colors of the first and second pigments combine to cause a change in color. The change in color may be observed from either side of the closure device.

34 Claims, 16 Drawing Sheets

U.S. PATENT DOCUMENTS

| | | | |
|---|---|---|---|
| 5,554,093 | A | 9/1996 | Porchia et al. |
| 5,647,100 | A | 7/1997 | Porchia et al. |
| 5,664,299 | A | 9/1997 | Porchia et al. |
| 5,722,128 | A | 3/1998 | Toney et al. |
| 5,774,955 | A | 7/1998 | Borchardt et al. |
| 5,829,884 | A | 11/1998 | Yeager |
| 5,839,831 | A | 11/1998 | Mazzocchi |
| 5,878,468 | A | 3/1999 | Tomic et al. |
| 5,911,508 | A | 6/1999 | Dobreski et al. |
| 6,082,897 | A | 7/2000 | Galomb |
| 6,152,600 | A | 11/2000 | Tomic |
| 6,217,215 | B1 | 4/2001 | Tomic |
| 6,231,236 | B1 | 5/2001 | Tilman |
| 6,293,701 | B1 | 9/2001 | Tomic |
| 6,371,644 | B1 | 4/2002 | Forman |
| 6,594,872 | B2 | 7/2003 | Cisek |
| 6,692,147 | B2 | 2/2004 | Nelson |
| 6,713,152 | B2 | 3/2004 | Chen et al. |
| 2004/0013323 | A1 | 1/2004 | Withers |
| 2004/0047521 | A1 | 3/2004 | Berich et al. |
| 2004/0074799 | A1 | 4/2004 | Bell et al. |
| 2004/0234170 | A1 | 11/2004 | Pawloski et al. |
| 2004/0234171 | A1 | 11/2004 | Dais et al. |
| 2004/0252915 | A1 | 12/2004 | Nelson |

FOREIGN PATENT DOCUMENTS

| | | |
|---|---|---|
| GB | 1260764 | 1/1972 |
| WO | WO 98/57863 | 12/1998 |
| WO | WO 01/94226 A1 | 12/2001 |

CLOSURE DEVICE

TECHNICAL FIELD OF THE INVENTION

The present invention is directed towards the field of interlocking closure devices and associated containers. The closure devices of the invention may be employed in traditional fastener areas, and are particularly suitable for use as fasteners for storage containers, such as plastic bags.

BACKGROUND OF THE INVENTION

The use of fastening devices for the closure of containers, including plastic bag bodies, is generally known. Furthermore, the manufacture of fastening devices made of plastic materials is generally known to those skilled in the art relating to closure devices, as demonstrated by the numerous patents in this area.

A particularly well-known use for fastening devices is in connection with flexible containers, such as bag bodies. The closure device and the associated container may be formed from thermoplastic materials, and the closure device and sidewalls of the container can be integrally formed by extrusion as a single piece. Alternatively, the closure device and sidewalls may be formed as separate pieces and then connected by heat sealing or any other suitable connecting process. The closure devices, when incorporated as fasteners on bag bodies, have been particularly useful in providing a closure means for retaining the contents of the bag body within the bag body.

Conventional closure devices utilize mating male and female closure elements which are occluded to effect closure of the device. It is often difficult to determine when the male and female closure elements are occluded. Accordingly, when conventional closure devices are employed, there exists a likelihood that the closure device is at least partially open.

The prior art discloses closure devices that attempt to resolve these issues. For example, the prior art has provided various closure devices having male and female closure elements, wherein one of the closure elements is blue and the other is yellow. When the blue and yellow closure elements are properly occluded, the closure device appears green, thus providing a visual confirmation that the closure device has been properly occluded. The change in color that is viewed when dissimilarly colored male and female members are occluded is demonstrated in a commercially available product sold under the trademark GLAD-LOCK® (Glad-Lock is the registered trademark of The Glad Products Company, Oakland, Calif.).

The aforementioned GLAD-LOCK® product has provided a closure device that overcomes the drawbacks inherent in previously known devices, and has enjoyed considerable consumer acceptance. Notwithstanding the commercial acceptance of the aforementioned product, improved closure devices are continually sought. It has been observed that the color-changing property of a closure device is most effective when the width of the closure element is relatively narrow, that is, when the closure device has a width of about 90 mils. However, when the closure device is narrow, it is more difficult to properly align the closure elements of such a closure device. Accordingly, it has been found that consumers prefer closure devices having a width on the order of about 180 mils to about 380 mils.

When the width of the closure device is increased, however, the effectiveness of the color-changing indicator can be somewhat diminished. The color change effect between occluded and unoccluded is diminished. In the aforementioned GLAD-LOCK® product, the color-changing effect is accomplished by forming one of the closure elements as an opaque yellow color and the other as a translucent blue color. The green color obtained upon occlusion of the two closure elements is viewed through the translucent blue-colored element. As the closure elements are made larger to accommodate consumer preferences, there is more area to provide for visual overlap between the opaque yellow and translucent blue closure elements when the closure elements are not fully occluded. The color of the blue element thus may appear to be blue-green at the points or regions where the elements are in close proximity but are unoccluded. Therefore, the contrast between the appearance of the translucent blue closure element in the unoccluded state and the occluded state is reduced.

A need accordingly exists for a wider closure device that more easily may be occluded by a user while also effectively exhibiting the visual color-changing effect provided by narrower closure devices. The prior art has disclosed several solutions to the aforesaid use of wider closure devices, including, for example, a closure device that incorporates a color-changing enhancement member within the device to improve the color change perception in wider color change closure devices. One such improved color change closure device is disclosed in U.S. Pat. No. 4,829,641. Although this color-change closure device enhanced color-changing effectiveness in wider closure devices and is beneficial, a further improvement in a color-changing closure device is beneficial as the closure device gets wider. A need therefore exists for a color change closure device capable of high contrast between the different colors viewable in the occluded and unoccluded states and has the desired width for tactile manipulation.

It is a general object of the present invention to provide a closure device that satisfies the foregoing needs.

BRIEF SUMMARY OF THE INVENTION

In accordance with one embodiment of the present invention, a closure device having first and second fastening strips separated by an intermediate area is provided. The first and second fastening strips are arranged to be interlocked over a predetermined length. Each of said first and second fastening strips includes first and second closure elements, wherein the first closure element on the first fastening strip is arranged to be interlocked over a predetermined length with the first closure element on the second fastening strip, and wherein the second closure element on the first fastening strip is arranged to be interlocked over a predetermined length with the second closure element on the second fastening strip. In one embodiment the closure elements on the first fastening strip are opaque and the intermediate area on that fastening strip is transparent or opaque. The closure elements on the second fastening strip are translucent, and the intermediate area on that fastening strip is transparent.

DETAILED DESCRIPTION OF THE INVENTION

In accordance with the invention, the closure device comprises first and second fastening strips arranged to be interlocked over a predetermined length. Each of the fastening strips includes one or more closure elements. The closure elements may be "male" closure elements or "female" closure elements. As used herein and as generally understood in the art, the terms "male" and "female" closure elements refer to closure elements wherein the element that interlocks into the other closure element and having outwardly projecting hooks is referred to as the "male closure element" and the other element is referred to as the "female closure element" and has inwardly projecting hooks. These terms are conventionally used to describe closure elements having the foregoing configurations.

Figure 1:
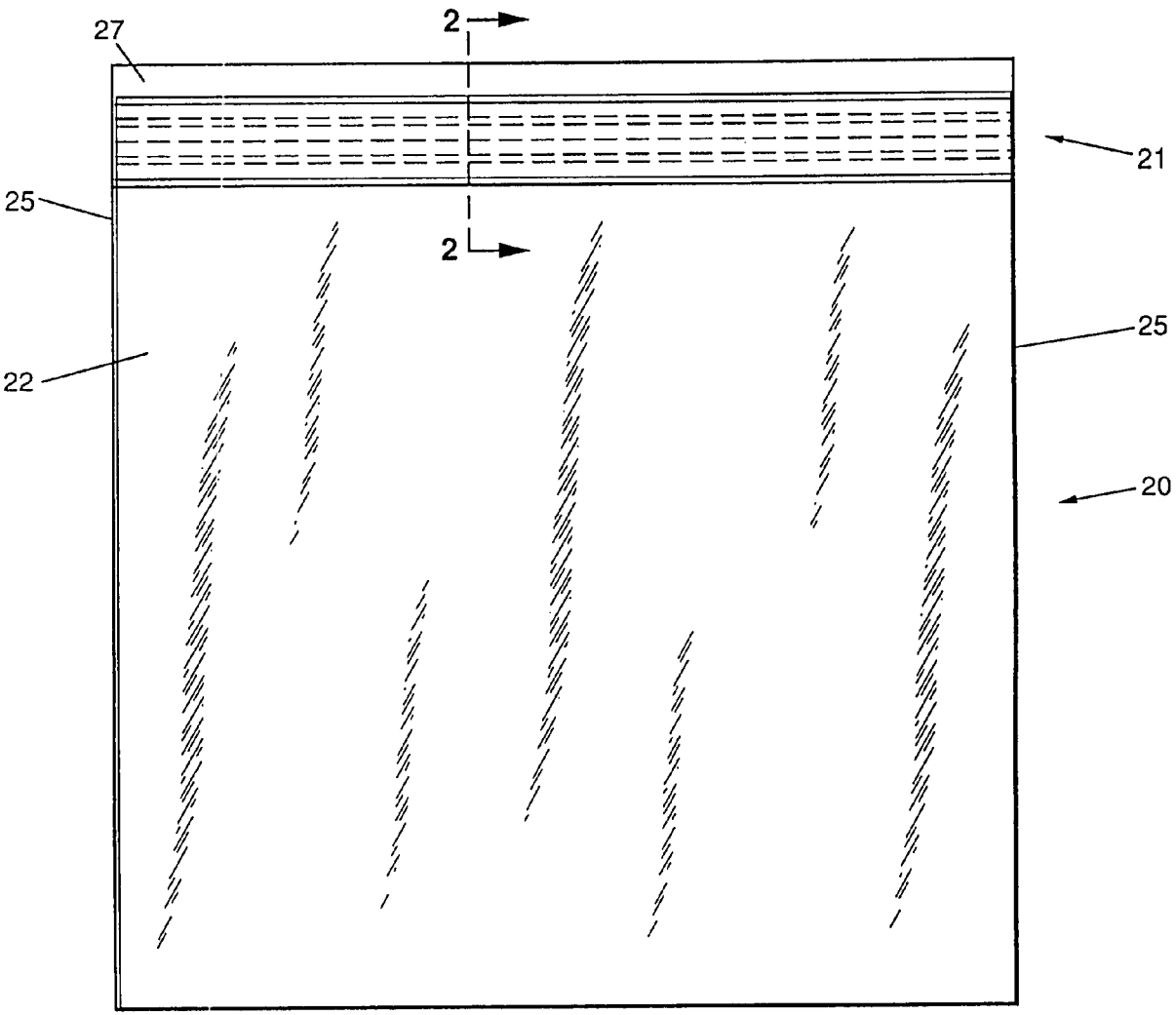
FIG. 1 is a perspective view of a container according to the present invention in the form of a plastic bag.

FIG. 1 illustrates a container according to the present invention in the form of a plastic bag 20 having a sealable closure device 21. The bag 20 includes side walls 22 joined at seams 25 to form a compartment sealable by means of the closure device 21. The side walls 22 extend above the closure device 21 to form mouth portions 27. The mouth portions 27 enable a user to grip the plastic bag 20 in a fashion to more conveniently be able to unocclude or open the closure device 21 and to thereby open the bag 20.

Figure 2:
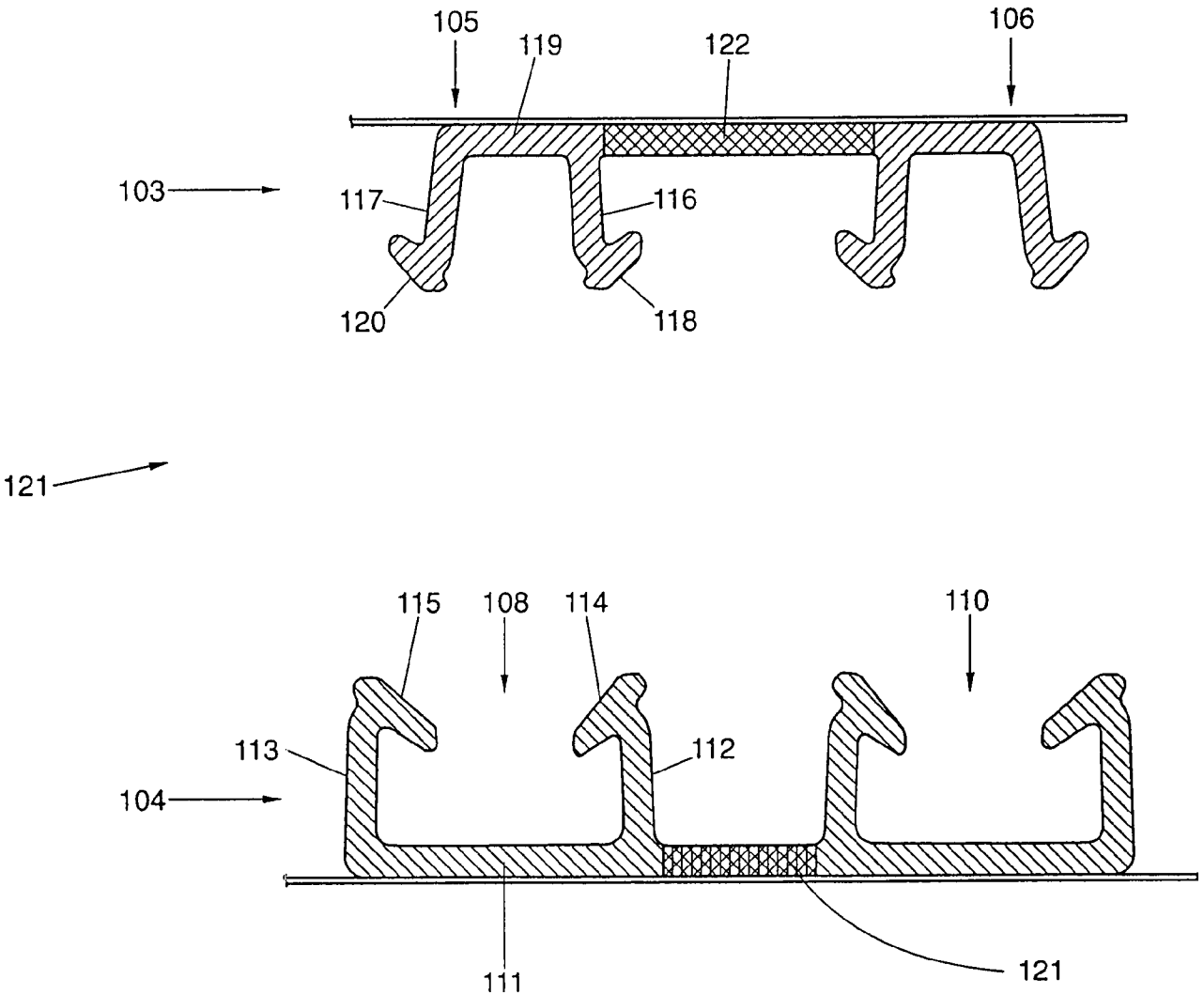
FIG. 2 is a cross-sectional view taken along line 2-2 in FIG. 1, illustrating a fastening strip of a closure device of the present invention.

FIG. 2 illustrates one embodiment of the closure device of the invention. The closure device 121 includes a first fastening strip 103 and a second fastening strip 104. The first fastening strip 103 includes male U-channel closure elements 105, 106. The second fastening strip 104 includes female U-channel closure elements 108, 110.

The closure element 108 comprises a base 111 having a pair of spaced-apart, parallely disposed webs 112, 113 extending therefrom. Each of the webs 112, 113 includes a hook 114, 115 extending therefrom and facing inwardly. The closure element 110 is similar to the closure element 108. The closure element 108 is separated from the closure element 110 by an intermediate area 121.

The closure element 105 comprises a pair of spaced-apart, parallely disposed webs 116, 117 extending upwardly from a base 119. Each of the webs 116, 117 has a hook 118, 120 extending therefrom and facing outwardly. The closure element 106 is similar to the closure element 105. The closure elements 105, 106 are separated by an intermediate area 122.

According to the text entitled "Practical Color Measurement" authored by Anni Berger-Schunn and published by John Wiley & Sons, Inc. Copyright 1994 page 13, all materials and objects can be divided into three groups with respect to color: (1) transparent; (2) translucent; and (3) opaque or reflecting. Transparent materials "absorb a part of the illuminating light [and] the other part goes unscattered through the sample . . . [Transparent materials] can be colored or uncolored." Translucent materials "not only absorb part of the incident light and transmit the other part but also scatter a part of the nonabsorbed light . . . The scattered part is partly transmitted and partly reflected." Opaque or reflecting materials "either absorb the incident light or reflect it . . . No light is transmitted." Practical Color Measurement page 13. As used herein, the term "non-colored transparent" is considered to be a color, even though the material does not exhibit a color.

The first and second closure elements 105, 106 on the first fastening strip 103 are a first color. For example, the first and second closure elements 105, 106 may be translucent blue. The intermediate area 122 is a second color. For example, the intermediate area 122 may be non-colored transparent.

The first and second closure elements 108, 110 on the second fastening strip 104 are a third color. For example, the first and second closure elements 108, 110 may be opaque yellow. The intermediate area 121 is a fourth color. For example, the intermediate area 121 may be non-colored transparent or may be opaque white. As is readily apparent from the aforementioned colors, so long as the objectives of the instant invention are achieved, the closure colors and combined closure colors can be repeated for a given closure device.

Figure 3A:
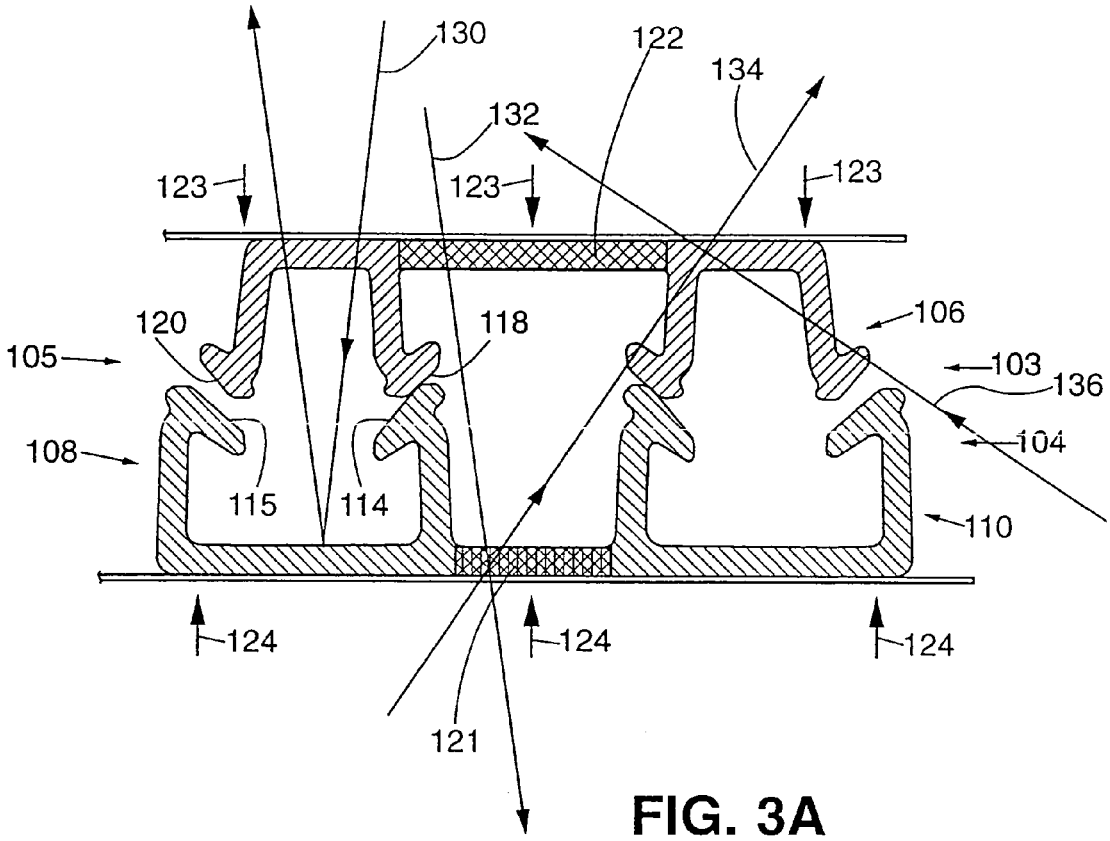
FIG. 3A is a cross-sectional view of one embodiment in the unoccluded position showing light rays contacting the closure device.
Figure 3B:
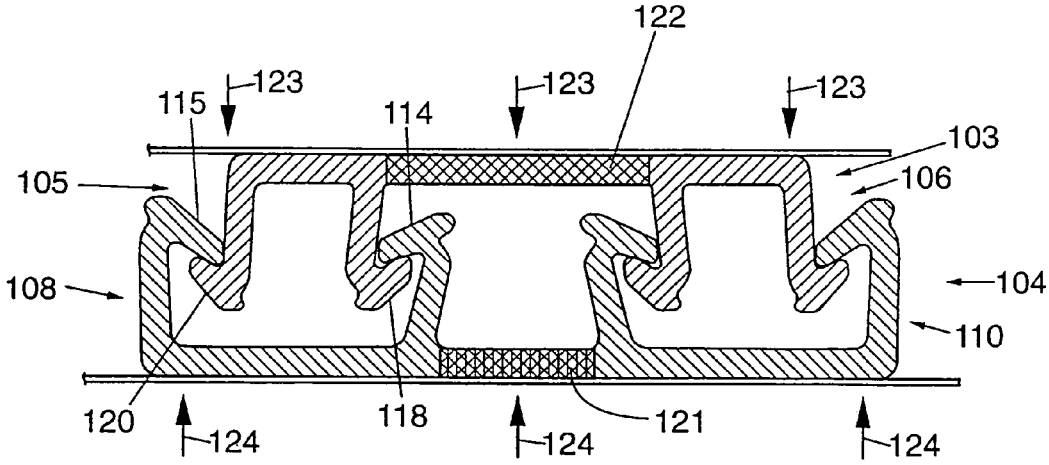
FIG. 3B is a view of the embodiment in FIG. 3A in the occluded position.

Occlusion of the closure device is illustrated in FIGS. 3A and 3B. The user applies forces in the directions indicated by arrows 123 and 124. The first male closure element 105 on the first fastening strip 103 engages the first female closure element 108 on the second fastening strip 104. Similarly, the second male closure element 106 on the first fastening strip 103 engages the second female closure element 110 on the second fastening strip 104. When the closure device is occluded, as shown in FIG. 3B, the hooks 118, 120 of the mating male closure elements engage the hooks 114, 115 of the female closure elements.

Figure 3C:
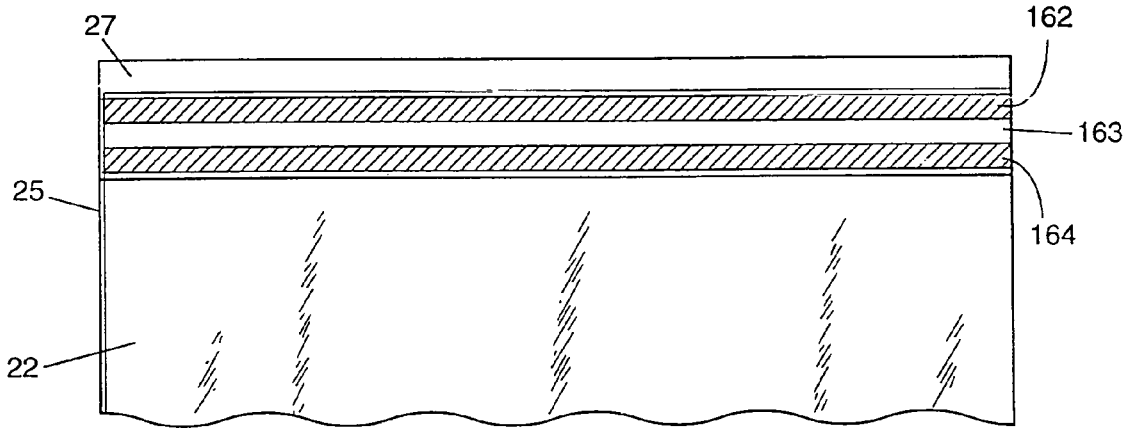
FIG. 3C is a partial front view of the container illustrating the color change areas on the closure device in FIG. 3B.

FIGS. 3A and 3B illustrate one embodiment of the invention. The intermediate areas 121, 122 of each fastening strip 103, 104 are transparent, translucent or non-colored transparent. For the purpose of discussion, intermediate areas 121 and 122 shall be referred to in this embodiment as non-colored transparent. The closure elements 105, 106 may be a first color, for example, translucent blue. The closure elements 108, 110 may be a second color, for example, opaque yellow. As illustrated in FIG. 3C, the occluded closure device thus appears as having three distinct bands, 162, 163, 164. The bands 162, 163, 164 appear green, transparent, and green, respectively.

Other combinations of colors in the closure elements could be used to create a third color, such as:

| First Color | Second Color | Third Color |
|---|---|---|
| Pink/Red | Blue | Purple |
| Red | Yellow | Orange |

FIG. 3A also illustrates incident light which enters the closure device prior to occlusion. For this example, the closure elements 105, 106 are translucent blue, the intermediate area 122 is non-colored transparent, the closure elements 108, 110 are opaque yellow and the intermediate area 121 is non-colored transparent. The non-colored light ray 130 enters the translucent blue closure element 105, bends after striking the opaque yellow closure element 108 and exits the translucent blue closure element 105 as a blue green light ray. The term "bend" includes, but is not limited to, reflection and refraction. In addition, non-colored light includes, but is not limited to, non-visible sunlight, incandescent light and fluorescent light. The non-colored light ray 132 enters the non-colored transparent intermediate area 122 and exits the non-colored transparent intermediate area 121 as a non-colored light ray. The non-colored light ray 134 enters the non-colored transparent intermediate area 121 and. exits the translucent blue closure element 106 as a blue light ray. The non-colored light ray 136 enters the translucent blue closure element 106 and exits the translucent blue closure element 106 as a blue light ray.

The non-colored transparent intermediate areas 121, 122 allow light rays to enter the closure device. For example, if the intermediate area 121 was opaque, then light ray 134 could not enter the closure device. The additional light entering the closure device improves the color change effect.

Figure 3D:
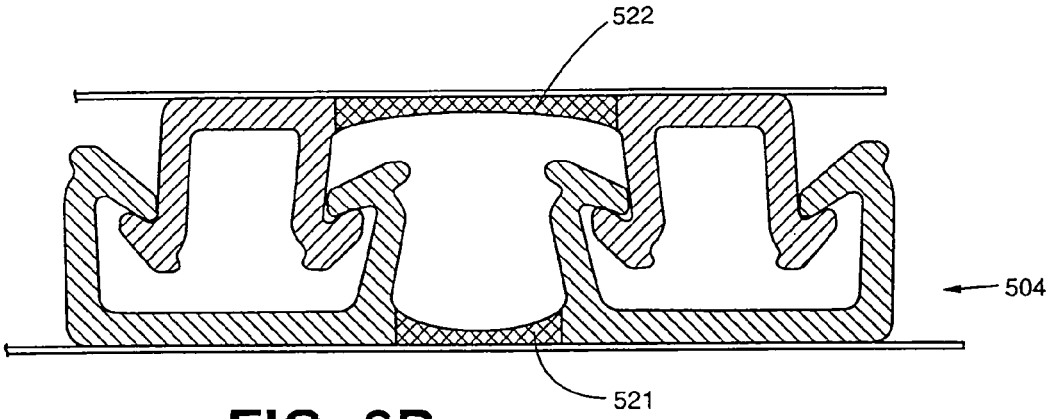
FIG. 3D is a cross-sectional view of another embodiment in the occluded position showing the lens feature of the intermediate area.
Figure 3E:
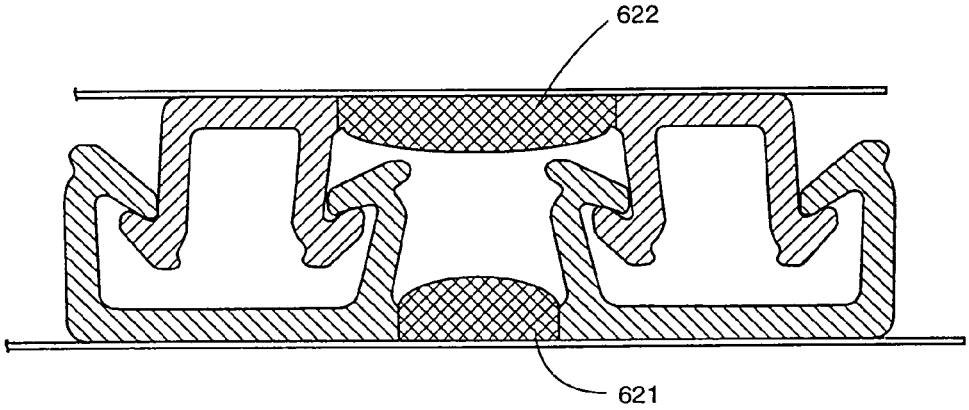
FIG. 3E is a cross-sectional view of another embodiment in the occluded position showing the lens feature of the intermediate area.
Figure 3F:
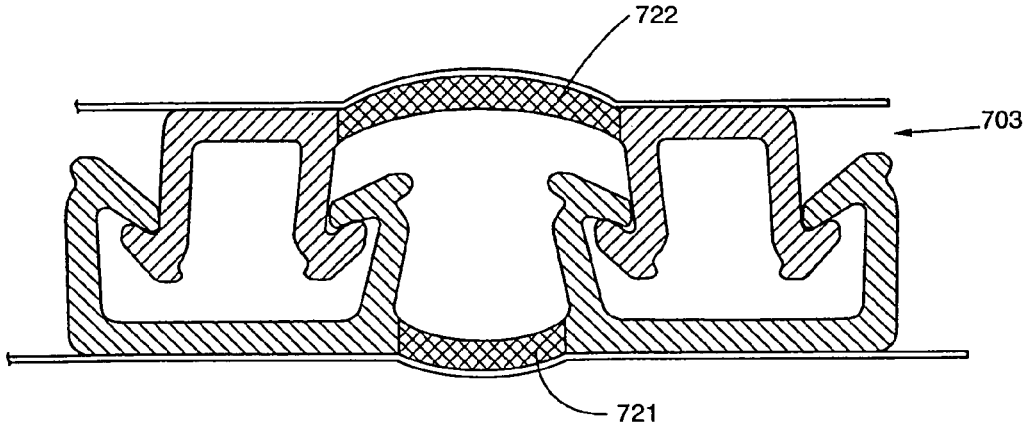
FIG. 3F is a cross-sectional view of another embodiment in the occluded position showing the lens feature of the intermediate area.
Figure 3G:
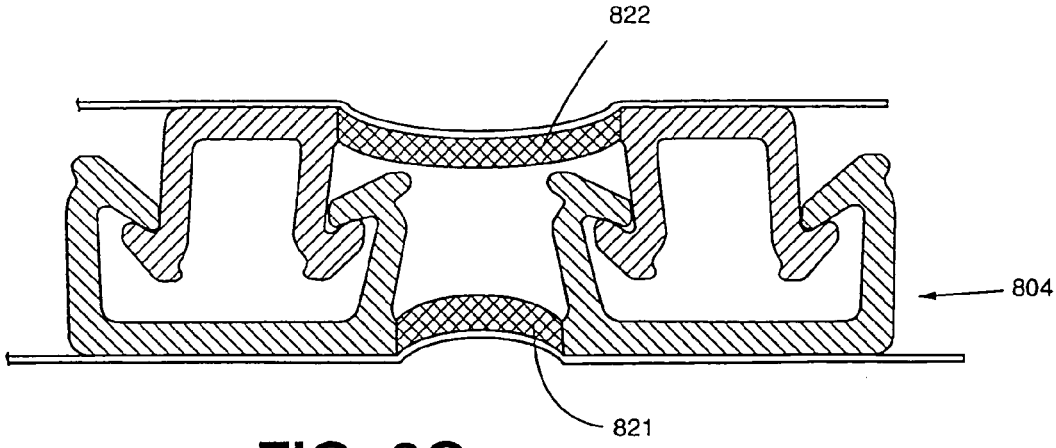
FIG. 3G is a cross-sectional view of another embodiment in the occluded position showing the lens feature of the intermediate area.
Figure 3H:
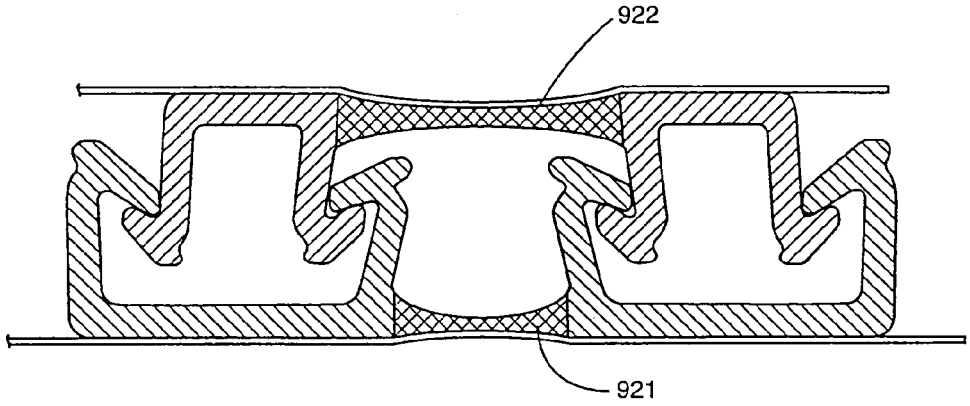
FIG. 3H is a cross-sectional view of another embodiment in the occluded position showing the lens feature of the intermediate area.
Figure 3I:
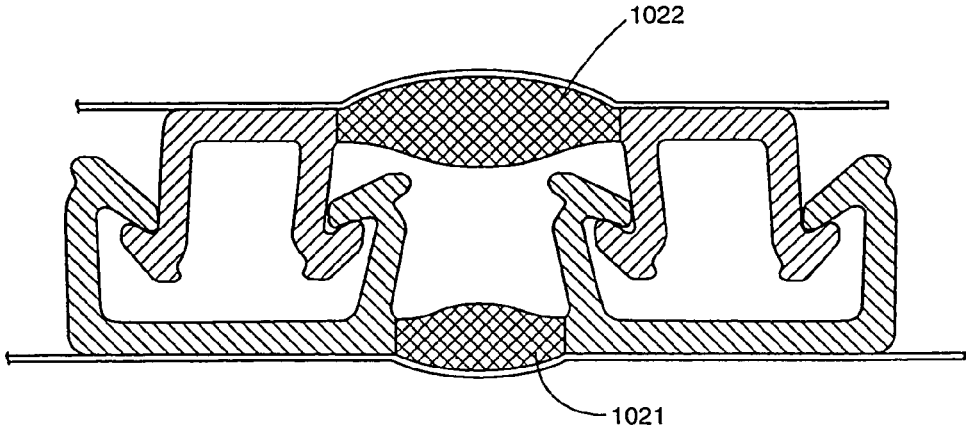
FIG. 3I is a cross-sectional view of another embodiment in the occluded position showing the lens feature of the intermediate area.

FIGS. 3D-3I illustrate embodiments which use the intermediate area as a lens to direct the light rays to predetermined locations. The material and structure would be selected to achieve the desired bending of the light rays. Referring to FIG. 3D, the intermediate areas 521, 522 on the mating side of the fastening strips are concave. Referring to FIG. 3E, the intermediate areas 621, 622 on the mating side of the fastening strips are convex. As shown in FIG. 3F, the intermediate areas 721, 722 on the mating side of the fastening strips are concave and on the non-mating side are convex. In FIG. 3G, the intermediate areas 821, 822 on the mating side of the fastening strips are convex and on the non-mating side are concave. As illustrated in FIG. 3H, the intermediate areas 921, 922 on the mating side of the fastening strips are concave and on the non-mating side are also concave. In FIG. 3I, the intermediate areas 1021, 1022 on the mating side of the fastening strips are convex and on the non-mating side are also convex. In addition, these fastening strips can be combined in various combinations. For example, fastening strip 103 in FIG. 3A could be combined with fastening strip 504 in FIG. 3D. As another example, fastening strip 703 in FIG. 3F could be combined with fastening strip 804 in FIG. 3G. The lens structure can be formed at the time the fastening strip is made. Furthermore, the lens structure may be formed by deformation of the fastening strip upon occlusion or unocclusion of the closure device as disclosed in pending U.S. patent application Ser. No. 08/673,653 filing date Jun. 28, 1996 (Internal Reference No. D 15712) which is incorporated herein by reference. Of course, lens structures other than a convex or concave surface or multiple concave and/or convex surfaces could be used to achieve the desired effect. This lens feature can be used, as appropriate with any embodiment disclosed herein.

Figure 4A:
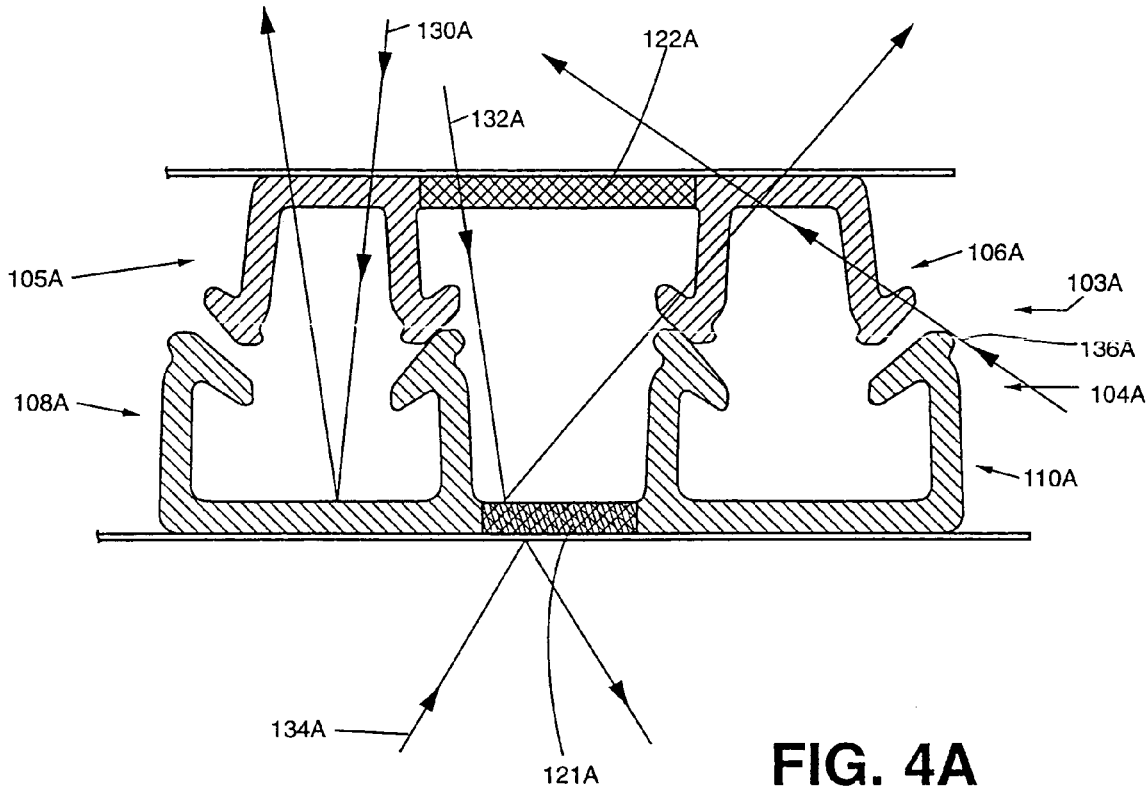
FIG. 4A is a cross-sectional view of another embodiment in the unoccluded position showing light rays contacting the closure device.
Figure 4B:
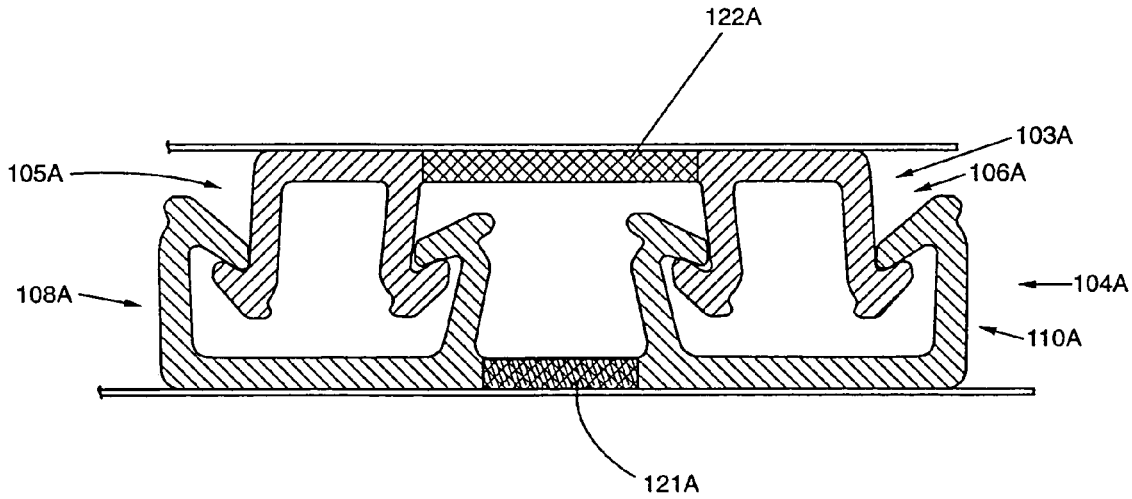
FIG. 4B is a view of the embodiment in FIG. 4A in the occluded position.
Figure 4C:
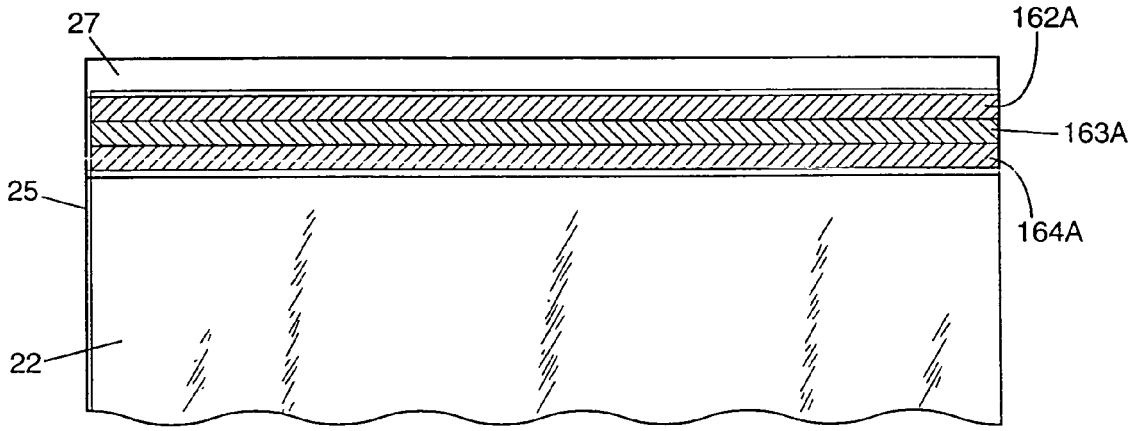
FIG. 4C is a partial front view of the container illustrating the color change areas on the closure device in FIG. 4B.

FIGS. 4A and 4B illustrate another embodiment of the invention. The closure elements 105A, 106A on the first fastening strip 103A may be a first color, such as, translucent blue. The intermediate area 122A is non-colored transparent. The closure elements 108A, 110A on the second fastening strip 104A may be a second color, such as, opaque yellow. The intermediate area 121A may be a third color, such as, white. As illustrated in FIG. 4C, the occluded closure device thus appears as having three distinct bands 162A, 163A, 164A. The bands 162A, 163A, 164A appear green, white, and green respectively.

FIG. 4A also illustrates incident light which enters the closure device prior to occlusion. For this example, the closure elements 105A, 106A are translucent blue, the intermediate area 122A is non-colored transparent, the closure elements 108A, 110A are opaque yellow and the intermediate area 121A is white. The non-colored light ray 130A enters the translucent blue closure element 105A, bends after striking the opaque yellow closure element 108A and exits the translucent blue closure element 105A as a blue green light ray. The non-colored light ray 132A enters the transparent intermediate area 122A, bends after striking the white intermediate area 121A, and exits the translucent blue closure element 106A as a blue light ray. The non-colored light ray 134A bends after striking the white intermediate area 121A as a white light ray. The non-colored light ray 136A enters the translucent blue closure element 106A and exits the translucent blue closure element 106A as a blue light ray.

The intermediate area 121A provides a background for the other colors in the closure device. For example, if the intermediate area 121A is white, then the light ray 132A exits as a blue light ray. If the intermediate area 121A was another color, this color would affect the light ray 132A. Thus, the intermediate area can provide a background color which improves the color change effect.

Figure 5A:
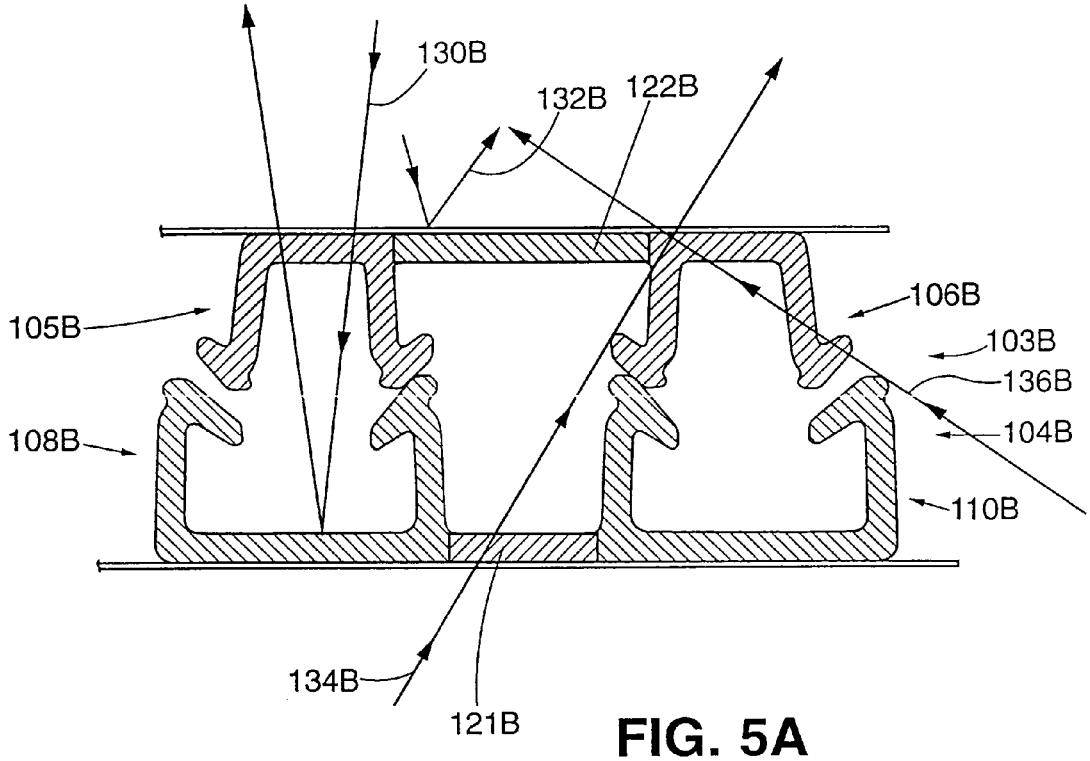
FIG. 5A is a cross-sectional view of another embodiment in the unoccluded position showing light rays contacting the closure device.
Figure 5B:
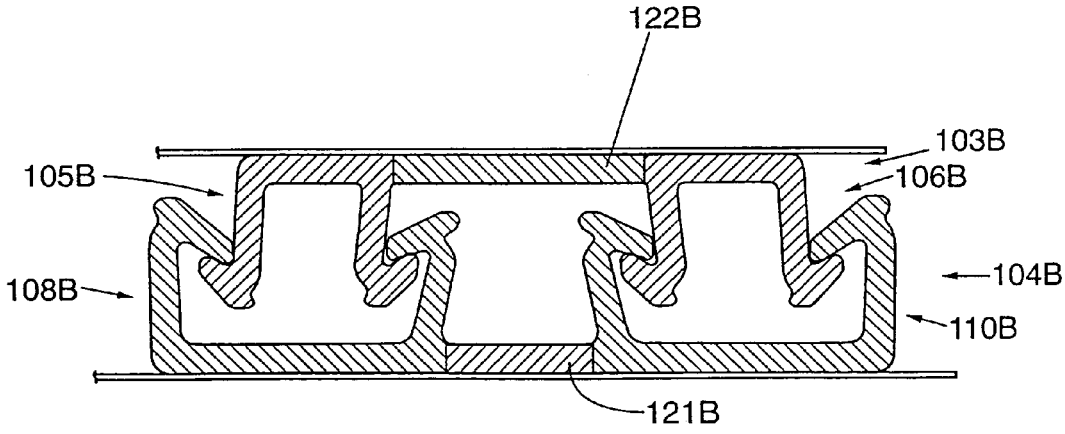
FIG. 5B is a view of the embodiment in FIG. 5A in the occluded position.
Figure 5C:
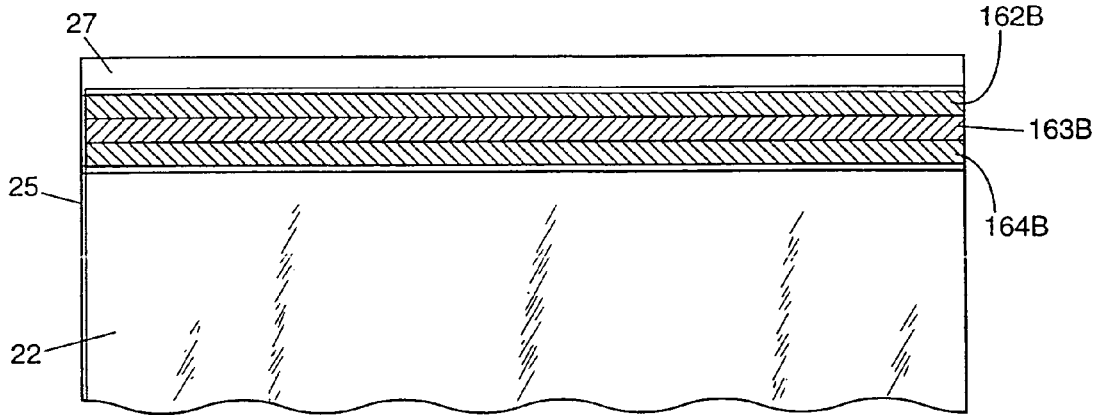
FIG. 5C is a partial front view of the container illustrating the color change areas on one side of the closure device in FIG. 5B.
Figure 5D:
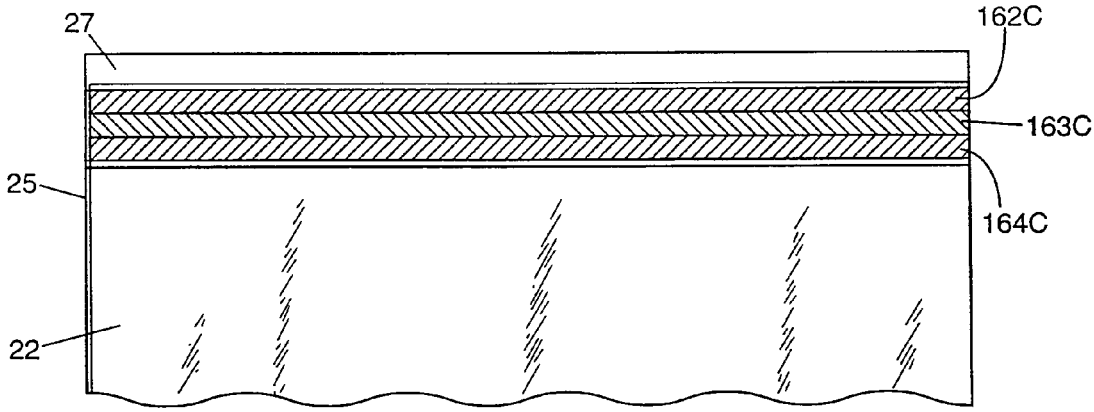
FIG. 5D is a partial front view of the container illustrating the color change areas on the other side of the closure device in FIG. 5B.

FIGS. 5A and 5B illustrate another embodiment of the invention. The closure elements 105B, 106B on the first fastening strip 103B and the intermediate area 121B on the second fastening strip 104B are a first color, such as, transparent blue. The intermediate area 122B on the first fastening strip 103B and the closure elements 108B, 110B on the second fastening strip 104B are a second color, such as, opaque yellow. When the fastening strips are brought together for occlusion of the closure device, the closure device will appear to have three distinct bands of color when viewed from either side of the closure device. For example, as illustrated in FIG. 5C, the bands 162B, 163B, 164B on one side of the closure device will appear green, yellow, and green, respectively. As illustrated in FIG. 5D, the bands 162C, 163C, 164C on the other side of the closure device will appear yellow, green, and yellow, respectively. Because the green color will appear on both sides of the closure device, the device will provide a visual indication of occlusion from either side of the closure device.

FIG. 5A also illustrates incident light which enters the closure device prior to occlusion. For this example, the closure elements 105B, 106B are translucent blue, the intermediate area 122B is opaque yellow, the closure elements 108B, 110B are opaque yellow and the intermediate area 121B is translucent blue. The non-colored light ray 130B enters the translucent blue closure element 105B, bends after striking the opaque yellow closure element 108B and exits the translucent blue closure element 105B as a blue green light ray. The non-colored light ray 132B bends after striking the opaque yellow intermediate area 122B as a yellow light ray. The non-colored light ray 134B enters the translucent blue intermediate area 121 B and exits the translucent blue closure element 106B as a blue light ray. The non-colored light ray 136B enters the translucent blue closure element 106B and exits the translucent blue closure element 106B as a blue light ray.

Figure 6A:
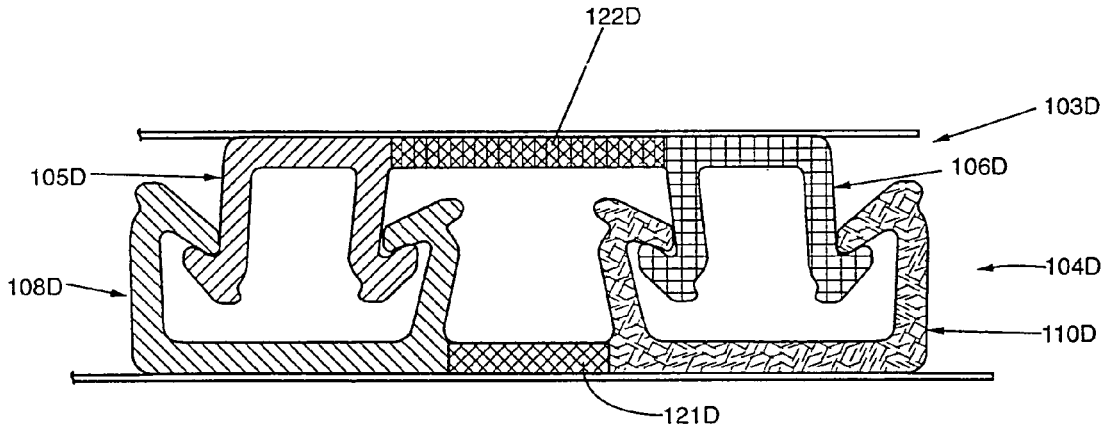
FIG. 6A is cross-sectional view of another embodiment in the occluded position.

FIG. 6A illustrates another embodiment of the invention. The first closure element 105D on the first fastening strip 103D is a first color and the second closure element 106D on the first fastening strip 103D is a second color. The first closure element 108D on the second fastening strip 104D is a third color and the second closure element 110D on the second fastening strip 104D is a fourth color. The first intermediate area 122D on the first fastening strip 103D is a seventh color and the second intermediate area 121D on the second fastening strip 104C is an eighth color. When the fastening strips are brought together for occlusion of the closure device, the first color and third color produce a fifth color, the second color and the fourth color produce a sixth color, and the seventh color and eighth color produce a ninth color.

Figure 6B:
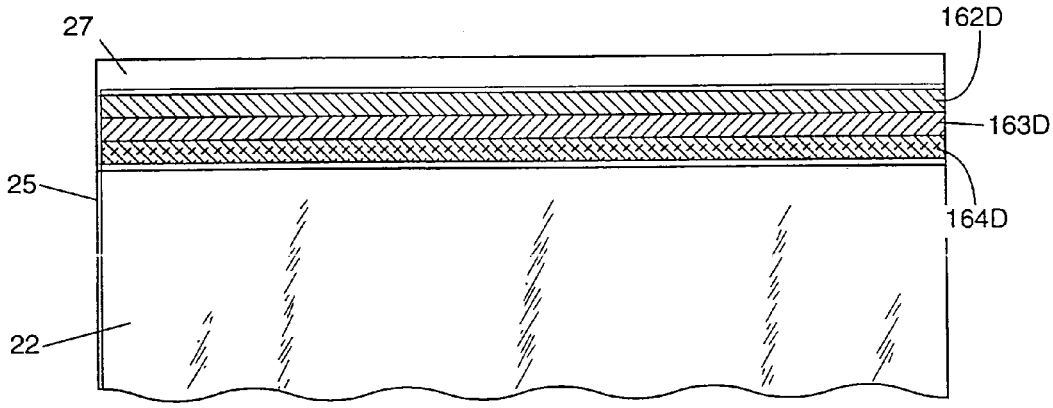
FIG. 6B is a partial front view of the container illustrating the color change areas on one side of the closure device in FIG. 6A.
Figure 6C:
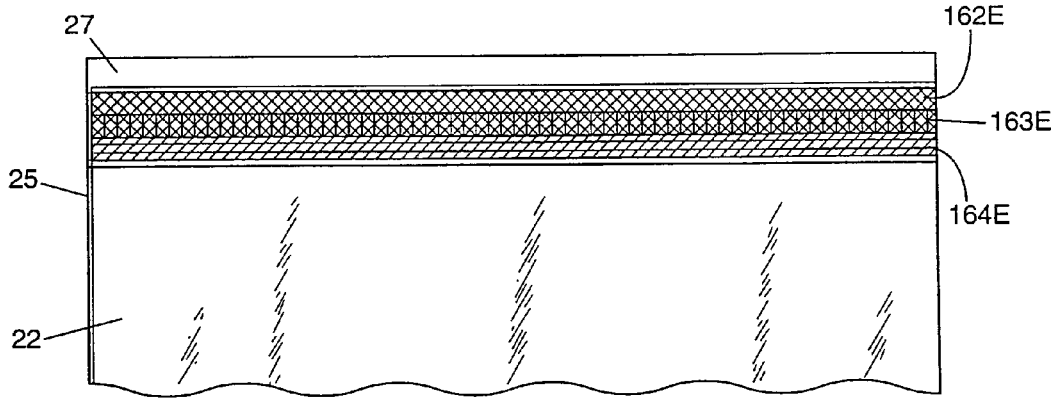
FIG. 6C is a partial front view of the container illustrating the color change areas on the other side of the closure device in FIG. 6A.

For example, the first color may be translucent blue and the third color may be an opaque yellow which produce the fifth color of green. The second color may be a translucent white and the fourth color may be an opaque black which produce the sixth color of gray. The seventh color may be an opaque blue and the eighth color may be a translucent red which produce the ninth color of purple. The closure device will appear to have three distinct bands of color when viewed from either side of the closure device. For example, as illustrated in FIG. 6B, the bands 162D, 163D, 164D on one side of the closure device will appear green, blue and gray, respectively. As illustrated in FIG. 6C, the bands 162E, 163E, 164E on the other side of the closure device will appear yellow, purple, and black, respectively. Because the color change effect will appear on both sides of the closure device, the device will provide a visual indication of occlusion from either side of the closure device.

Figure 7:
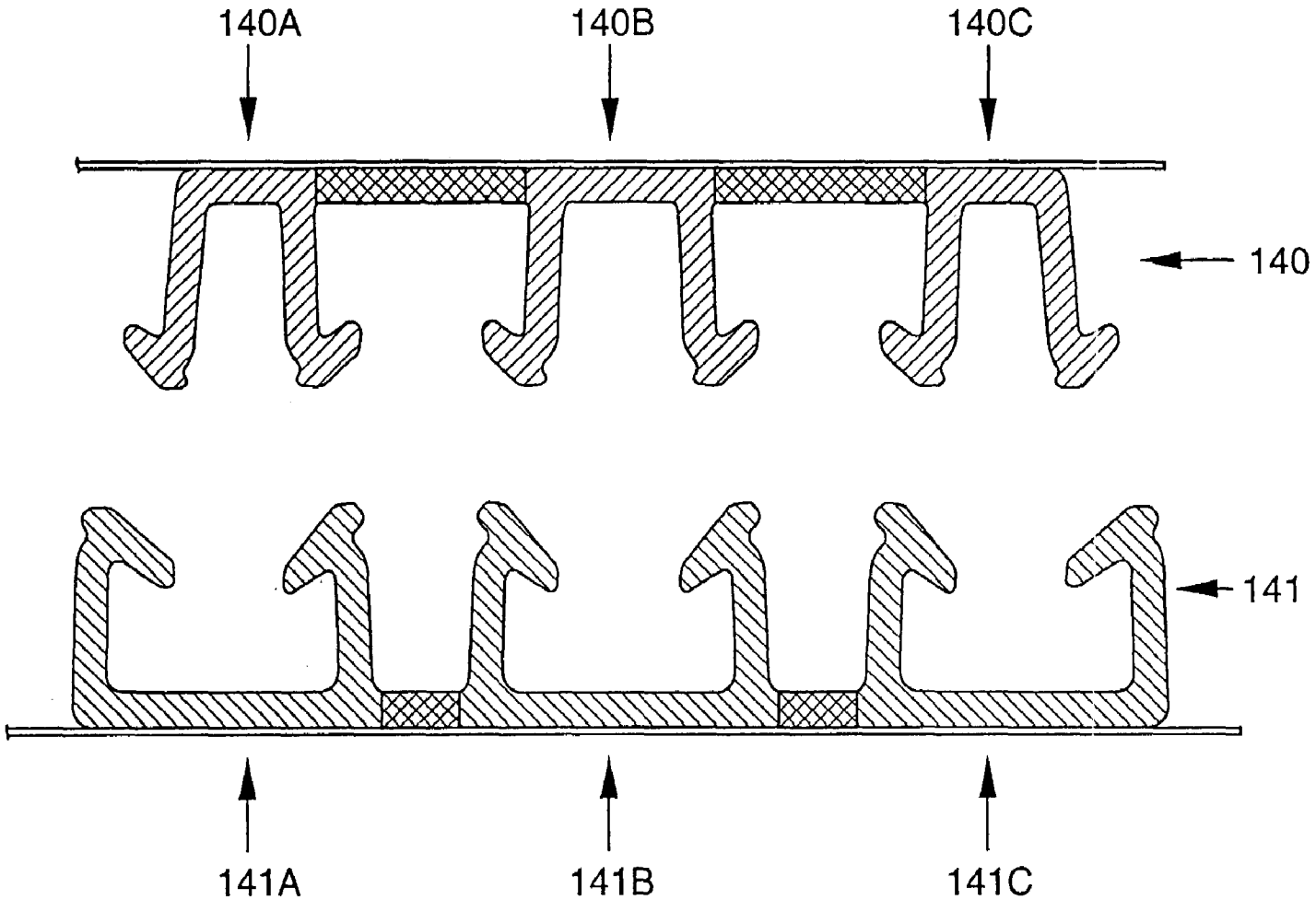
FIG. 7 is a cross sectional view of another embodiment of the closure device of the invention illustrating fastening strips with three closure elements.

Other combinations of closure elements may be advantageously employed. For instance, FIG. 7 illustrates a closure device including two fastening strips 140, 141, wherein each of the fastening strips includes three closure elements 140A-140C, 141A-141C. The closure elements illustrated in FIG. 7 are all U-channel closure elements similar to FIG. 2. However, other closure elements may be used as well. The fastening strip may further include a greater number of closure elements, if desired. The number of colors could be increased by six colors for each pair of closure elements and each pair of intermediate areas which are added.

Figure 8:
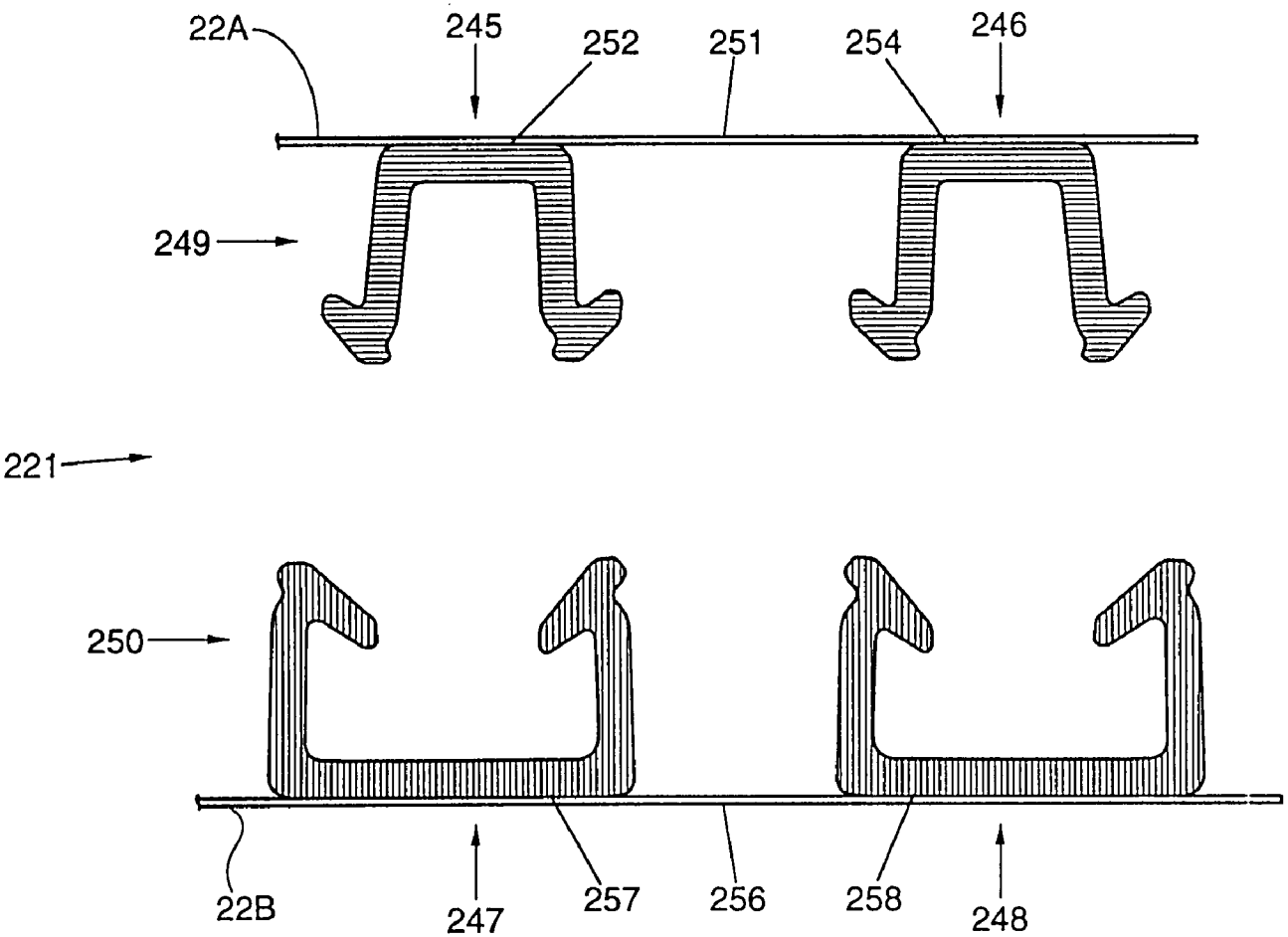
FIG. 8 is a cross-sectional view of another embodiment of the invention, illustrating a closure device having closure elements that have been separately applied onto the fastening strip or sidewalls of the container.

FIG. 8 illustrates another embodiment of a closure device 221 in accordance with the invention wherein the closure elements 245, 246, 247, 248 have been extruded separately onto the sidewall 22 to form fastening strips 249, 250. As illustrated, each of the first and second closure elements 245, 246 on the first fastening strip 249 extend from the side wall 22A which becomes the base of the fastening strip. The area 251 of the side wall 22A between the base 252 of the first closure element 245 and the base 254 of the second closure element 246 forms the intermediate area 251 of the fastening strip 249. Similarly, the area 256 between the base 257 of the first closure element 247 and the base 258 of the second closure element 248 forms the intermediate area 256 of the fastening strip 250.

The closure elements 245, 246, 247, 248 may include colors as noted above. For example, the closure elements 245, 246 may be translucent blue and the closure elements 247, 248 may be opaque yellow. In addition, the intermediate areas 251, 256 may include colors as noted above. For example, the intermediate area 251 may be non-colored transparent and the intermediate area 256 may be non-colored transparent or may be opaque white. The opaque white may by created by applying paint or other material to the intermediate area 256 or by coextruding a white portion of the side wall 22B at the intermediate area 256.

The fastening strips 249, 250 are occluded in the same fashion as the fastening strips in FIGS. 2-4B and would achieve similar color change effects.

Figure 9:
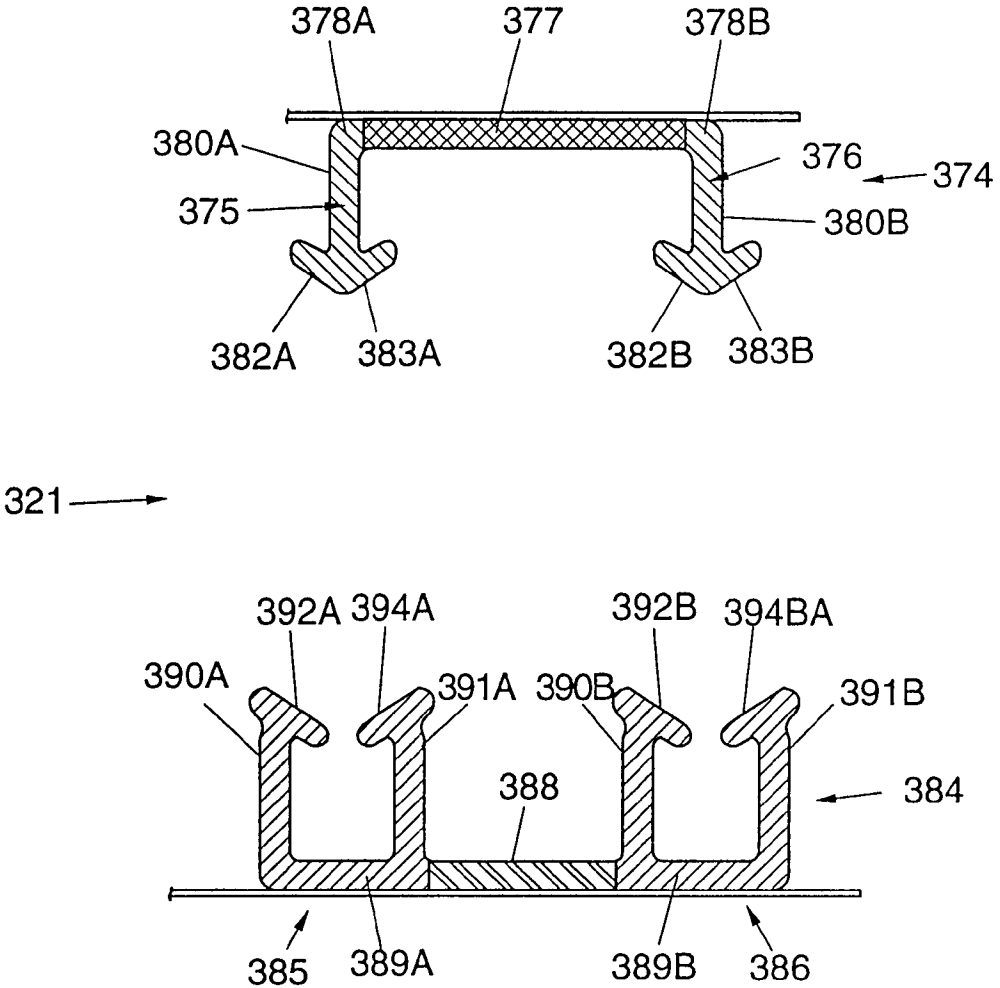
FIG. 9 is a cross-sectional view of another embodiment of a closure device in accordance with the present invention.

FIG. 9 illustrates another embodiment of a closure device in accordance with the invention. The closure device 321 includes a first fastening strip 374 and a second fastening strip 384. The fastening strip 374 comprises two male arrowhead closure elements 375, 376 separated by an intermediate area 377. Each of the male arrowhead closure elements 375, 376 comprises a base 378A, 378B having a web 380A, 380B extending therefrom and each web includes hooks 382A, 382B, 383A, 383B extending therefrom on either side.

The second fastening strip 384 comprises female closure elements 385, 386 separated by an intermediate area 388 on the fastening strip. Each of the female closure elements 385, 386 comprises a base 389A, 389B having a pair of spaced-apart, parallely disposed webs 390A, 390B, 391A, 391B extending therefrom. The webs terminate in inwardly facing hooks 392A, 392B, 394A, 394B.

The closure elements 375, 376 on the first fastening strip are a first color. For example, the closure elements 375, 376 may be translucent blue. In addition, the intermediate area 377 is a second color. For example, the intermediate are 377 may be non-colored transparent.

The closure elements 385, 386 on the second fastening strip are a third color. For example, the first and second closure elements 385, 386 may be opaque yellow. The intermediate area 388 is a fourth color. For example, the intermediate area 381 may be non-colored transparent or may be opaque white.

Figure 10:
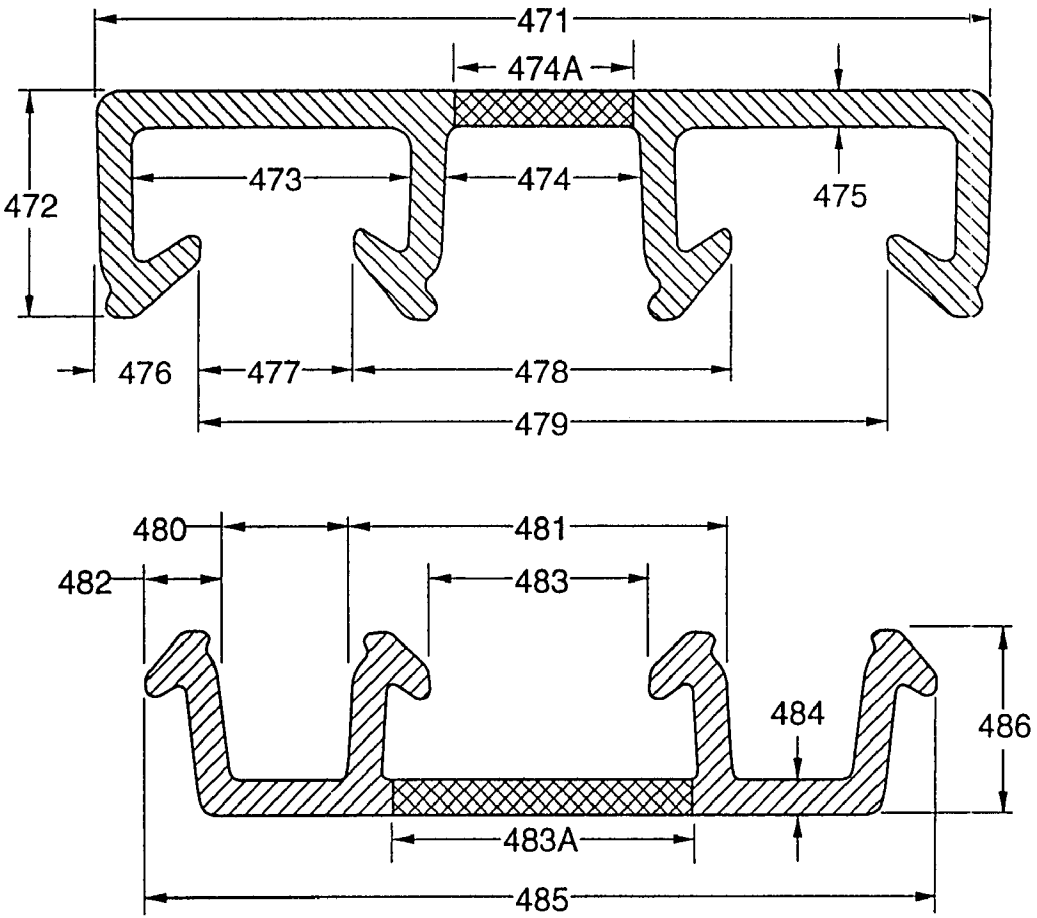
FIG. 10 is a cross sectional view of one embodiment of the closure device of the invention.

FIG. 10 illustrates male and female fastening strips of one embodiment of the closure device of the present invention. The representative dimensions of the various parameters are given as follows:

| Parameter | Range (mils) | Preferred (mils) |
|---|---|---|
| 471 | 0.283-0.363 | 0.323 |
| 472 | 0.029-0.099 | 0.064 |
| 473 | 0.048-0.128 | 0.088 |
| 474A | 0.022-0.092 | 0.057 |
| 474 | 0.035-0.105 | 0.070 |
| 475 | 0.008-0.018 | 0.013 |
| 476 | 0.022-0.052 | 0.037 |
| 477 | 0.015-0.095 | 0.055 |
| 478 | 0.096-0.176 | 0.136 |
| 479 | 0.206-0.286 | 0.246 |
| 480 | 0.013-0.083 | 0.048 |
| 481 | 0.098-0.168 | 0.133 |
| 482 | 0.012-0.042 | 0.027 |
| 483 | 0.041-0.111 | 0.076 |
| 483A | 0.076-0.146 | 0.111 |
| 484 | 0.008-0.018 | 0.013 |
| 485 | 0.242-0.322 | 0.282 |
| 486 | 0.018-0.088 | 0.053 |

In general, the closure elements of the invention may be formed from thermoplastic materials, such as, for example, polyethylene, polypropylene, nylon, or the like, or from combinations among the foregoing. Thus, resins or mixtures of resins such as high density polyethylene, medium density polyethylene, and low density polyethylene employed to prepare the novel fastener invention. Preferably, the closure elements are made from low density polyethylene. The selection of the thermoplastic material will be related to the closure design and its Young's modulus and desired elasticity and flexibility, correlated to provide the functionality of the closure as herein claimed.

When the closure device of the present invention is used in conjunction with a sealable bag, the fastener and the films that form the body of the bag can be made from heat-sealable material. The bag thus can be formed economically by heat sealing the aforementioned components to form the bag. Preferably, the bag is made from a mixture of high pressure, low density polyethylene and linear low density polyethylene.

The closure elements of the invention may be manufactured by extrusion or other known methods. The closure device can be manufactured in the form of individual fastening strips for later attachment to a film. Alternatively, the fastening strips can be manufactured as integral portions of a film, and the film formed into a bag body. In addition, the fastening strips can be manufactured with or without flange portions on one or both of the fastening strips, depending upon the intended use or expected additional manufacturing operations. The use of flange portions is known to those of ordinary skill in the art.

If the closure device is manufactured as individual fastening strips for later attachment to a film, the device may be integrally connected to the sidewalls of a container by the use of any of many known methods. For example, a thermoelectric device can be applied to a film in contact with a flange portion of the fastening strip, or the thermoelectric device can be applied to a film in contact with the base portion of a closure element having no flange portion, to cause a transfer of heat through the film to produce melting at the interface of the film and flange portion or base portion of a closure element. Suitable thermoelectric devices include heated rotary disks, traveling heater bands, resistance-heated slide wires, and the like. The connection between the fastening strip and container also can be established by the use of hot-melt adhesives, hot jets of air applied to the film to produce melting, ultrasonic heating, or other known methods.

The colors for the closure device may be added to the raw material for the closure device during manufacture (such as, by coextrusion) or the colors may be applied (such as, by painting) to the closure device or to portions of the side wall of the container.

Thus, the present invention provides a closure device that overcomes the drawbacks inherent in the prior art. Specifically, the invention affords a closure device that has a pronounced color change effect.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and co-pending applications cited herein are hereby incorporated by reference in their entireties.

What is claimed is:

1. A closure device comprising first and second fastening strips arranged to be interlocked over a predetermined length, said first fastening strip includes first and second closure elements, said second fastening strip includes first and second closure elements, said first closure element on said first fastening strip is arranged to be interlocked over a predetermined length with said first closure element on said second fastening strip, said second closure element on said first fastening strip is arranged to be interlocked over a predetermined length with said second closure element on said second fastening strip, said first closure element on said first fastening strip is of a first color, said second closure element on said first fastening strip is of a second color, said first closure element on said second fastening strip is of a third color, said second closure element on said second fastening strip is of a fourth color, whereby, when said first closure element on said first fastening strip interlocks with said first closure element on said second fastening strip, said first and third colors produce a fifth color and whereby, when said second closure element on said first fastening strip interlocks with said second closure element on said second fastening strip, said second and fourth colors produce a sixth color, said first and second closure elements on said first fastening strip are separated by a first intermediate area, said first and second closure elements on said second fastening strip are separated by a second intermediate area, said first intermediate area is a seventh color and said second intermediate area is an eighth color.

2. The invention according to claim 1 wherein said seventh color and said eighth color are transparent.

3. The invention according to claim 2 wherein said seventh color and said eighth color are non-colored transparent.

4. The invention according to claim 1 wherein said seventh color is transparent and said eighth color is white.

5. The invention according to claim 4 wherein said seventh color is non-colored transparent.

6. The invention according to claim 1 wherein said seventh color and said eighth color produce a ninth color.

7. The invention according to claim 6 wherein said third, fourth, and seventh colors are identical, said first, second, and eighth colors are identical and said fifth, sixth and ninth colors are identical.

8. The invention according to claim 7 wherein said third, fourth, and seventh colors are opaque yellow, said first, second, and eighth colors are translucent blue, and said fifth, sixth and ninth colors are green.

9. The invention according to claim 1 wherein said first and second colors are identical, said third and fourth colors are identical, and said fifth and sixth colors are identical.

10. The invention according to claim 9 wherein said first and second colors are yellow, said third and fourth colors are blue, and said filth and sixth colors are green.

11. The invention according to claim 10 wherein said first and second colors are opaque yellow, said third and fourth colors are translucent blue, said seventh color is transparent and said eighth color is transparent.

12. The invention according to claim 11 wherein said seventh color and said eighth color are non-colored transparent.

13. The invention according to claim 10 wherein said first and second colors are opaque yellow, said third and fourth colors are translucent blue, said seventh color is transparent and said eighth color is white.

14. The invention according to claim 13 wherein said seventh color is non-colored transparent.

15. The invention according to claim 1 wherein said first and second closure elements on said first fastening strip are male closure elements and said first and second closure elements on said second fastening strip are female closure elements.

16. The invention according to claim 15 wherein said first and second closure elements on said first fastening strip are arrowhead closure elements.

17. The invention according to claim 15 wherein said first and second closure elements on said first fastening strip are U-channel closure elements.

18. A container comprising first and second sidewalls, said first and second sidewalls including mating first and second fastening strips respectively, each of said first and second fastening strips includes first and second closure elements, said first closure element on said first fastening strip is arranged to be interlocked over a predetermined length with said first closure element on said second fastening strip, said second closure element on said first fastening strip is arranged to be interlocked over a predetermined length wit said second closure element on said second fastening strip said first closure element on said first fastening strip is of a first color, said second closure element on said first fastening strip is of a second color, said first closure element on said second fastening strip is of a third color, said second closure element on said second fastening strip is of a fourth color, whereby, when said first closure element on said first fastening strip interlocks with said first closure element on said second fastening strip, said first and third colors produce a fifth color and whereby, when said second closure element on said first fastening strip interlocks with said second closure element on said second fastening strip, said second and fourth colors produce a sixth color said first and second closure elements on said first fastening strip are separated by a first intermediate area, said first and second closure elements on said second fastening strip are separated by a second intermediate area, said first intermediate area is a seventh color and said second intermediate area is an eighth color.

19. The invention according to claim 18 wherein said seventh color and said eighth color are transparent.

20. The invention according to claim 19 wherein said seventh color and said eight color are non-colored transparent.

21. The invention according to claim 18 wherein said seventh color is transparent and said eight color is white.

22. The invention according to claim 21 wherein said seventh color is non-colored transparent.

23. The invention according to claim 18 wherein said seventh color and said eighth color produce a ninth color.

24. The invention according to claim 23 wherein said third, fourth, and seventh colors are identical, said first, second, and eighth colors are identical and said fifth, sixth and ninth colors are identical.

25. The invention according to claim 24 wherein said third, fourth, and seventh colors are opaque yellow, said first, second, and eighth colors are translucent blue, and said fifth, sixth and ninth colors are green.

26. The invention according to claim 18 wherein said first and second colors are identical, said third and fourth colors are identical, and said fifth and sixth colors are identical.

27. The invention according to claim 26 wherein said first and second colors are yellow, said third and fourth colors are blue, and said fifth and sixth colors are green.

28. The invention according to claim 27 wherein said fist and second colors are opaque yellow, said third and fourth colors are translucent blue, said seventh color is transparent and said eighth color is transparent.

29. The invention according to claim 28 wherein said seventh color and said eight color are non-colored transparent.

30. The invention according to claim 27 wherein said first and second colors are opaque yellow, said third and fourth colors are translucent blue, said seventh color is transparent and said eight color is white.

31. The invention according to claim 30 wherein said seventh color is non-colored transparent.

32. The invention according to claim 18 wherein said first and second closure elements on said first fastening strip are male closure elements and said first and second closure elements on said second fastening strip are female closure elements.

33. The invention according to claim 32 wherein said first and second closure elements on said first fastening strip are arrowhead closure elements.

34. The invention according to claim 32 wherein said first and second closure elements on said first fastening strip are U-channel closure elements.

* * * * *